US006929571B2

(12) United States Patent
Jesch et al.

(10) Patent No.: US 6,929,571 B2
(45) Date of Patent: Aug. 16, 2005

(54) BASKETBALL GOAL BASE PAD

(75) Inventors: Matthew D. Jesch, Indianapolis, IN (US); Scott Vaughn, Fishers, IN (US)

(73) Assignee: Infinity Machinery Service Co., Indianapolis, IN (US)

( * ) Notice: Subject to any disclaimer, the term of this patent is extended or adjusted under 35 U.S.C. 154(b) by 0 days.

(21) Appl. No.: 10/417,995

(22) Filed: Apr. 17, 2003

(65) Prior Publication Data

US 2004/0209714 A1 Oct. 21, 2004

(51) Int. Cl.[7] ..... A63B 63/08
(52) U.S. Cl. ..... 473/479; 267/140
(58) Field of Search ..... 473/479, 476, 473/473; 52/3, 170; 267/116, 140, 141.1; 428/81, 19, 12, 98, 99, 58; 150/901, 154; 248/601, 346.07, 346.01, 346.03–346.04; 182/137; 280/763.1; 138/155

(56) References Cited

U.S. PATENT DOCUMENTS

| | | | | | |
|---|---|---|---|---|---|
| 452,234 | A | * | 5/1891 | Perry | 182/137 |
| 1,489,204 | A | * | 4/1924 | Glen | 52/295 |
| 2,945,550 | A | | 7/1960 | Andreasen | |
| 3,181,849 | A | | 5/1965 | Mitchell | |
| 3,997,150 | A | | 12/1976 | Hanson | |
| 4,057,245 | A | | 11/1977 | Gordon | |
| 4,443,009 | A | | 4/1984 | Smith | |
| 4,606,167 | A | | 8/1986 | Thorne | |
| 4,748,060 | A | | 5/1988 | Fry et al. | |
| 5,173,990 | A | | 12/1992 | Owen | |
| 5,713,806 | A | | 2/1998 | Teitgen et al. | |
| 5,733,224 | A | | 3/1998 | Reid | |
| 5,869,159 | A | | 2/1999 | Padilla | |
| 5,913,778 | A | | 6/1999 | Hying et al. | |
| 6,216,414 | B1 | * | 4/2001 | Feldberg | 52/736.1 |
| 6,242,070 | B1 | * | 6/2001 | Gillispie et al. | 428/99 |
| 6,256,961 | B1 | * | 7/2001 | Byrnes | 52/736.4 |

* cited by examiner

*Primary Examiner*—Gregory Vidovich
*Assistant Examiner*—M. Chambers
(74) *Attorney, Agent, or Firm*—Maginot, Moore & Beck

(57) ABSTRACT

A protective apparatus for covering bolts and gussets of a mounting base of an in-ground anchoring system for a basketball goal post includes a shell formed of a resiliently deformable material. The shell includes a top wall defining a post opening configured to receive the goal post therethrough and at least one side wall integral with the top wall. The top wall and side walls define a cavity for enclosing the protruding features of the mounting base when the post is received in the opening of the top wall. An access opening is provided through which the goal post is maneuvered into the post opening. The access opening can be in the form of a slot or a closeable slit in the shell. In certain embodiments, a retention element is provided that attaches to the bolts of the mounting base to hold the protective apparatus in position.

14 Claims, 11 Drawing Sheets

20
52
22
38
82
72
70
80
86
74
66
57
54
56
69
96
84
100
58
64
78
73
68
94
40a
62
88
36
40d
98
94
46
28a
24
92
26
34
46
28d
30

BASKETBALL GOAL BASE PAD

BACKGROUND OF THE INVENTION

The present invention generally relates to protective guards or pads for placement around posts, and more particularly, to protective guards or pads for placement around posts that support basketball goals.

An outdoor post is sometimes anchored to the ground by bolting the post to a piece of concrete that is at least partially buried in the ground. For instance, an outdoor basketball goal is often mounted on a steel post that is anchored to the ground in such a manner.

FIG. 1 shows a basketball goal anchoring system 20 including a post 22, a rectangular plate 24, and an anchor 26. The anchor 26 includes bolts 28*a–d* each having one end that is imbedded in a concrete body 30. The opposite, threaded ends of the bolts project vertically upward from an upper surface 32 of the body 30. The post 22 includes a mounting base 34 having a rectangular rim 36 extending horizontally from the bottom end of a body 38 of the post 22. Gussets 40*a–d* provide support between the rim 36 and the body 38. The plate 24 and the rim 36 each include a set of thru-holes 42*a–d* and 44*a–d*, respectively.

With the anchor 26 being partially buried at a desired location in the ground, the plate 24 and the post 22 are placed over the anchor 26 such that the threaded ends of the bolts 28*a–d* are aligned with and pass through the thru-holes 42*a–d* and 44*a–d*. During this assembly of the post 22, plate 24 and anchor 26, an assortment of nuts 46 and washers 48 can be placed on the bolts 28*a–d*, as indicated in FIG. 1, in order to securely fasten the post 22, plate 24 and anchor 26 together. In the assembled state, the threaded ends of the bolts 28*a–d* on the base 34 can extend through and above the topmost nuts 46.

The rigidity of the steel post 22 and the immovable nature of the post 22 as it is mounted in the ground provide the basketball goal with the support and stability that is needed for the goal to withstand the impacts of basketballs and basketball players. Unfortunately, the rigidity and immobility of the post 22 also present a danger for the basketball players. Players colliding with the post 22 or falling or stepping on the bolts 28 and/or gussets 40 can be seriously injured.

In order to improve the safety of the basketball players, padding can be used to cover the sharp edges and corners of the basketball goal and/or the post. U.S. Pat. No. 5,713,806 discloses a pad that covers the lower corners and bottom edge of a basketball backboard. U.S. Pat. No. 3,181,849 discloses a shock absorbing guard that is wrapped around the post of a basketball goal. The padding disclosed in these two patents would leave the bolts 28 and gussets 40 exposed, however.

As another safety measure, four plastic caps 50, only two of which are shown, can be placed over the exposed threaded ends of the bolts 28. Although the caps 50 cover the sharp edges of the threaded ends of the bolts 28, they do little to reduce the hardness of the bolts 28 for players who might fall upon them. Moreover, as the caps 50 age and become brittle due to exposure to the outside environment, they tend to tear, get removed from the bolts 28 and/or get misplaced, thereby exposing the sharp edges of the bolts 28.

Another safety problem is presented by the gussets 40, which are typically triangular metal pieces welded between the body 38 and the rim 36. These gussets also have hard, sharp edges, which present another source of danger for players falling or stepping on the base 34 of the post 22.

Accordingly, there is a need for an apparatus for covering the base of a basketball goal post that would protect a player who falls or steps upon the base. The present invention addresses these and other needs.

SUMMARY OF THE INVENTION

In accordance with one aspect of the present invention, there is provided a protective apparatus that securely couples to the mounting base of an in-ground anchoring system for a basketball goal post and provides cushioning to protect a player who falls or steps upon the base.

The present invention comprises, in one embodiment thereof, a protective apparatus for covering protruding features on a mounting base of a basketball goal post. The apparatus includes a shell formed of a cushioning or resiliently deformable material. The shell includes a top wall defining an opening configured to receive the goal post. The shell also includes at least one side wall integral with or attached to the top wall. The top wall and the side walls define a cavity configured to enclose the protruding features when the goal post is received in the opening. In some embodiments, the side walls completely enclose the mounting base of the anchoring system, while in other embodiments one side of the shell is open.

In one feature of the invention, an access opening is defined in the shell that communicates with the post opening. The access opening allows maneuvering of the goal post into the post opening. In certain embodiments, the post opening and access opening form an open-ended slot in the shell, and preferably in the top wall of the shell. In other embodiments, the access opening is in the form of a closeable slit defined in the shell, either in the top wall, or in the top and one side wall. In some embodiments, the slit can be closed by an adhesive strip.

The present invention comprises, in another embodiment thereof, a protective apparatus for covering protruding features on a mounting base of a basketball goal post. The apparatus includes a shell having an opening configured to receive a body of the post. The shell defines a cavity receiving the features when the body of the post is received in the opening. A retention element is attached to the shell and retains the shell on the anchoring system.

The present invention comprises, in yet another embodiment thereof, a protective apparatus for covering a bolt at a base of a basketball goal post. The apparatus includes a shell formed of a cushioning or resiliently deformable material. The shell includes a top wall having an opening configured to receive a body of the post. At least one side wall is attached to the top wall. The top wall and the at least one side wall define a cavity receiving the bolt when the body of the post is received in the opening of the top wall. A retention element is attached to the shell and to the bolt.

An advantage of the protective apparatus of the present invention is that the pad is not easily decoupled from the base of the post. Another advantage is that the protective apparatus can be securely attached to the base of the post. Yet another advantage is that the protective apparatus covers both the bolts and the gussets of the base of the post. Other advantages and certain benefits of the invention can be appreciated from the following written description and accompanying figures.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DESCRIPTION OF THE PREFERRED EMBODIMENTS

Figure 1:
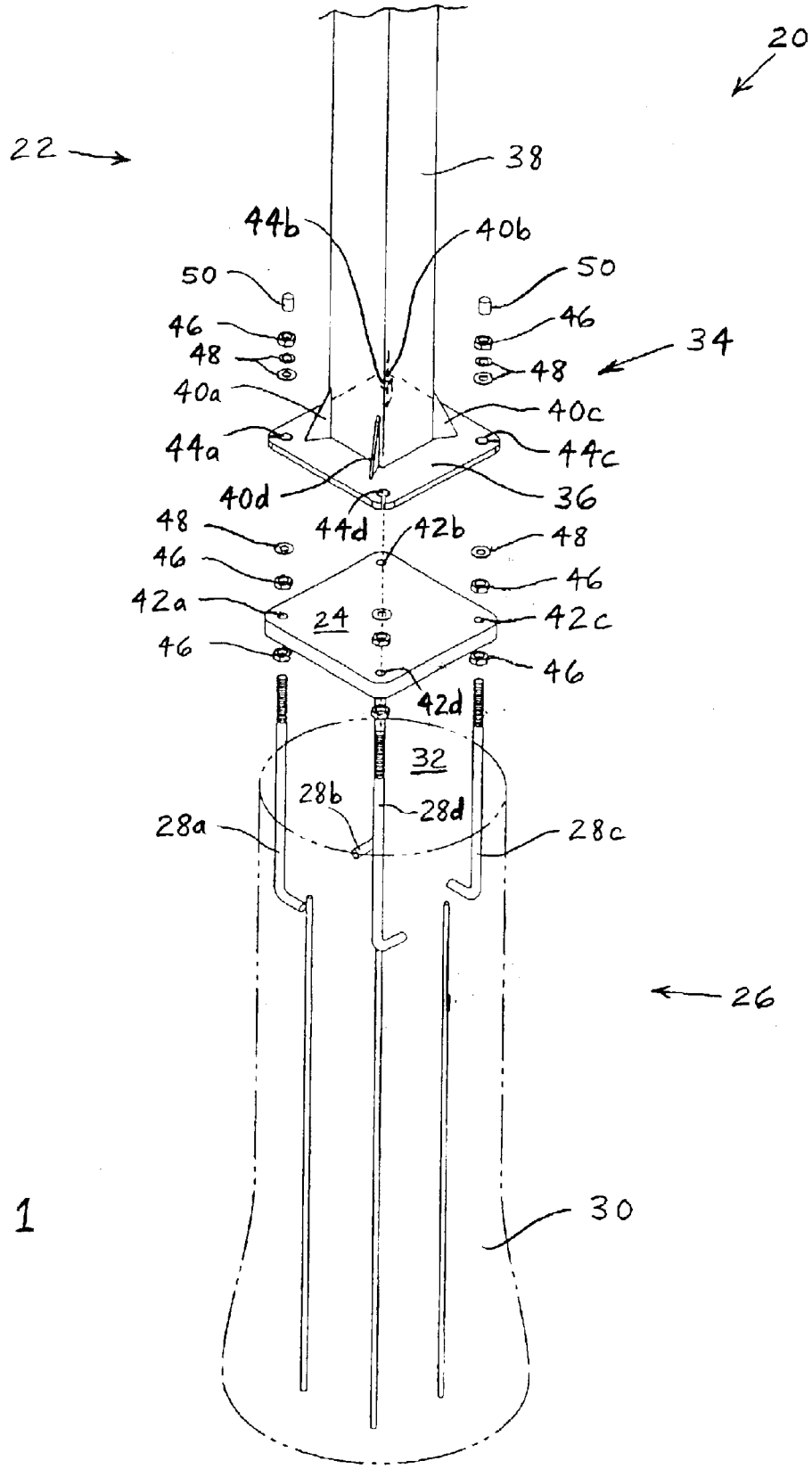
FIG. 1 is an exploded, perspective view of one embodiment of a basketball goal anchoring system of the prior art.
Figure 2:
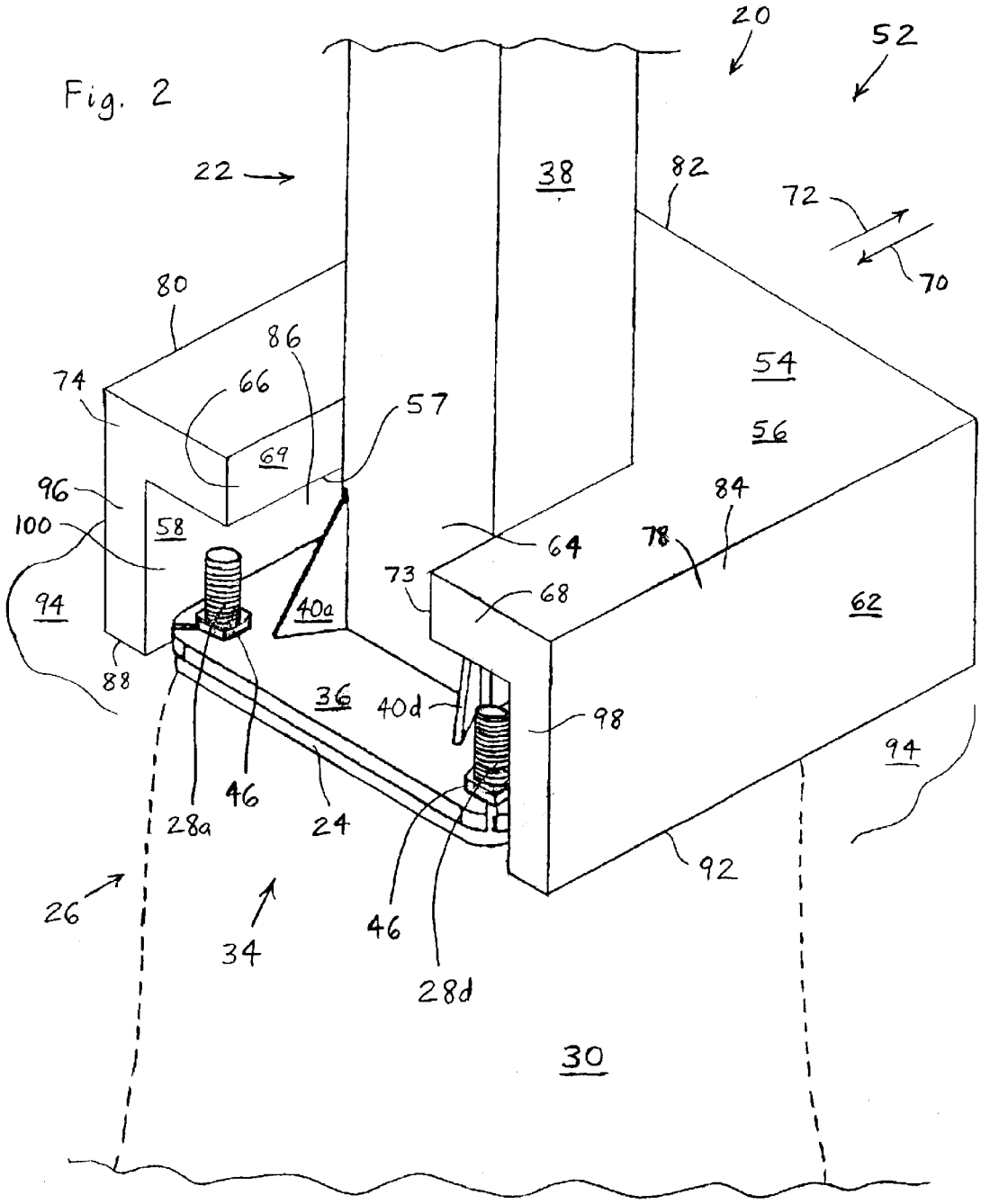
FIG. 2 is a perspective view of one embodiment of a basketball goal post protective apparatus of the present invention in its operative position over the base of the anchoring system of FIG. 1.

Referring now to FIG. 2, an exemplary basketball goal base pad in the form of a protective apparatus 52 constructed according to principles of the present invention is shown. The protective apparatus 52 is shown as covering the bolts 28*a–d* and the gussets 40*a–d* at the base 34 of the basketball anchoring system 20.

The protective apparatus 52 includes a shell 54 preferably formed of a cushioning material capable of resiliently absorbing the impact of a player striking the shell. The cushioning material can be a polyurethane or polyethylene foam, or a rubber, soft plastic or similar natural or synthetic material. Alternatively, the shell 54 can be formed of a stiffer material, such as a stiffer plastic material, that can serve to cover the sharp, hard edges of the bolts 28*a–d* and gussets 40*a–d*, provided that the material can resiliently absorb impact loads without fracture or failure.

Figure 3:
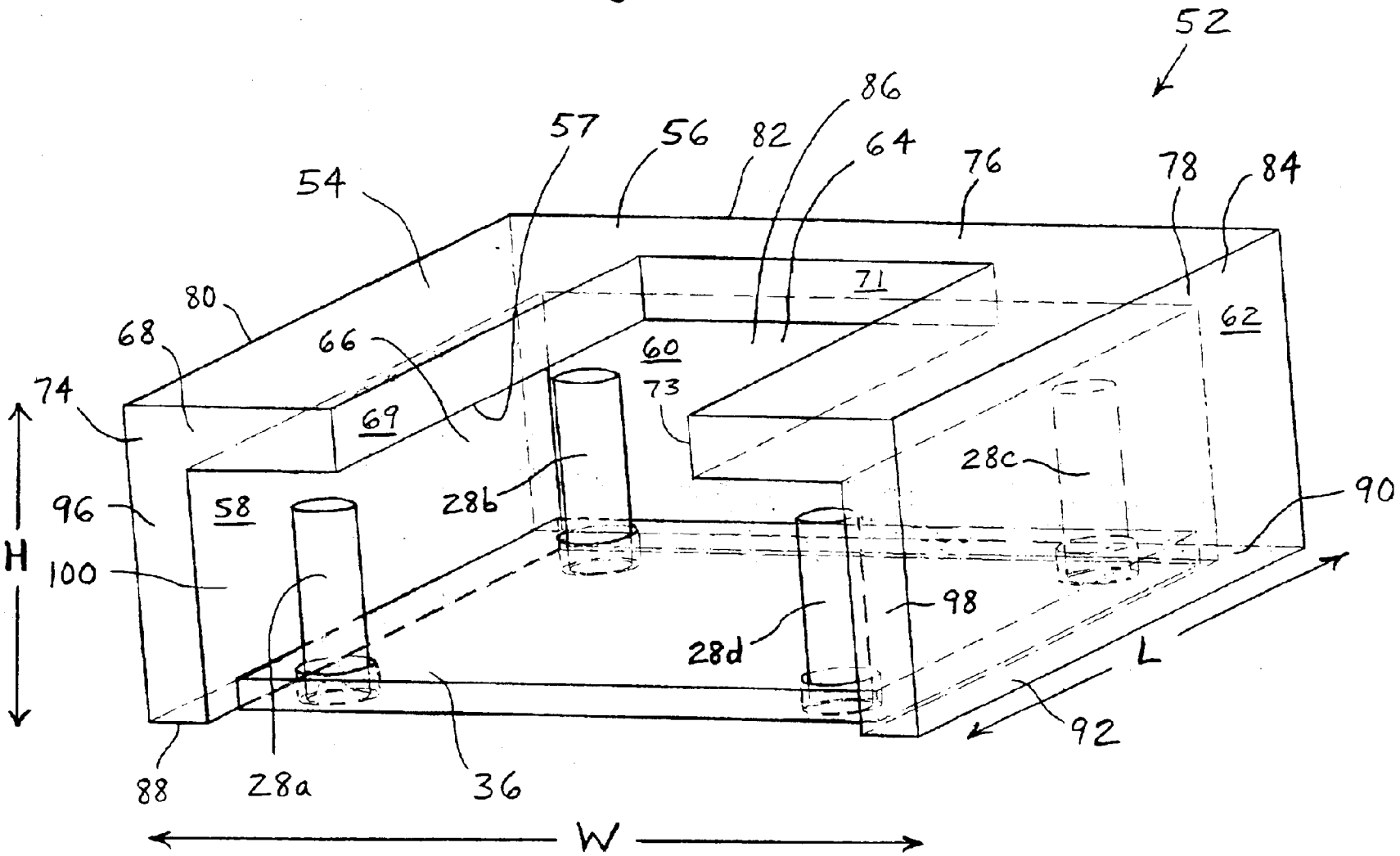
FIG. 3 is a perspective view of the protective apparatus of FIG. 2 and schematic representations of the rim and bolts of the anchoring system of FIG. 1.

The shell 54 includes a top wall 56 and at least one side wall configured to surround or encompass the base 34. In a preferred embodiment, three side walls 58, 60 and 62 are provided, as shown in FIG. 3, so the shell adopts a generally rectangular cube or block shape. The top wall 56 includes a post opening 64 in the form of a slot having an access opening 66 at an edge 68 of the top wall 56. The top wall 56 includes three lips 69, 71, 73 that define the post opening 64. The shell 54 is placed on the base 34 such that the body 38 of the post 22 is received in the post opening 64 and is engaged by the lips 69, 71 and 73. Typically, the access opening 66 is placed facing in a direction 70, as shown in FIG. 2, which is opposite to a direction 72 in which the backboard and the rim (not shown) of the basketball goal face. Such an orientation of the shell 54 provides a desirable level of coverage to the bolts 28*b*, 28*c* that are positioned generally between the post body 38 and the basketball court, and that are thus more likely than the bolts 28*a*, 28*d* to be impacted by a basketball player.

The side walls 58, 60, 62 have respective proximal ends 74, 76, 78 attached to edges 80, 82, 84, respectively, of the top wall 56. Thus, the top wall 56 and the side walls 58, 60, 62 define a cavity 86 therebetween. The side walls 58, 60, 62 also have respective outer or distal ends 88, 90, 92 resting upon a ground surface 94 adjacent the base 34. Thus, the side walls 58, 60, 62 support the top wall above the surface 94 such that the protruding features at the base 34, such as the bolts 28*a–d* and gussets 40*a–d*, are received in the cavity 86. Moreover, the shell 54 covers the rim 36 and the plate 24 and their sharp side edges. Rear edges 96, 98 of the side walls 58, 62, respectively, and the edge 68 of the top wall 56 define an access window 100 into the cavity 86 when the side walls 58, 62 rest upon the surface 94.

In a preferred embodiment, the shell 54 has a width W of 15.25 inches, a length L of 15.25 inches, and a height H of 6.0 inches. The height H is calibrated to provide clearance between the top wall 56 and the gussets and bolts. Preferably the height H is such that the underside surface 57 is immediately adjacent the joint between the gussets 40*a–d* and the post body 38. Also, the height preferably provides clearance of about 0.5–1.0 inch above the ends of the bolts 28*a–d*. This clearance allows the shell to deform before contacting the bolts, which will absorb some of the impact force. The outer dimensions of the shell are preferably calibrated to completely cover the base 34. Thus, the width W and length L can be slightly greater than the comparable dimensions of the plate 24 and rim 36 for a standard basketball goal installation. Preferably, the shell of the present invention is sized for universal use regardless of the dimensions of the base 34 and goal post 38. Thus, the outer dimensions of the shell can be larger than the largest anticipated goal post and base.

In the preferred embodiment, the post opening 64 has a width along the lip 71 of 6.25 inches, and a length along the lips 69 and 73 of 11.75 inches. The post opening 64 has a width sized to tightly fit against the body 38 of the post 22. With this tight fit, the shell 54 is firmly held in place and is not apt to be dislodged when impacted by a player. In addition, a snug fit between the post and the shell will create a modest weather barrier to shield at least some of the base 34 from the elements.

The shell 54 preferably has a thickness of about 2.0 inches when formed of a high density polyurethane foam. This thickness provides the shell with sufficient resilience and flexibility, coupled with sufficient stiffness, to adequately absorb impact loads. The thickness of the shell can be varied depending upon the particular material.

When installed as shown in FIG. 2, the protective apparatus 52 substantially covers the bolts 28*a–d* and gussets 40*a–d*. Thus, the apparatus 52 can cushion a basketball player who may fall or step near the base 34. The apparatus 52 can also shield the player from the sharp edges of the bolts 28*a–d* and gussets 40*a–d*. In these and other ways, the apparatus can prevent injury to the basketball player.

Figure 4:
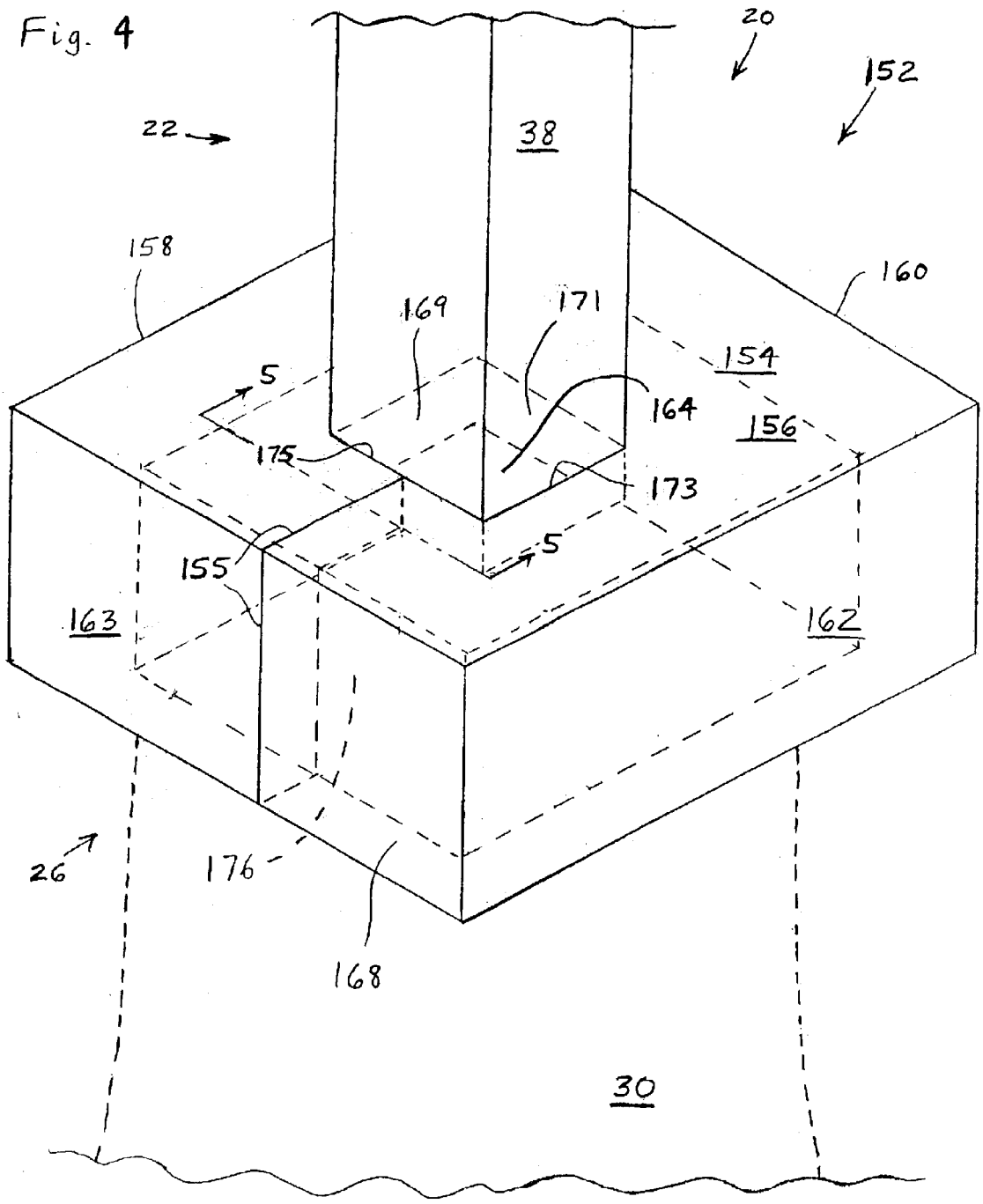
FIG. 4 is a perspective view of another embodiment of a basketball goal post protective apparatus of the present invention in its operative position over the base of the anchoring system of FIG. 1.
Figure 5:
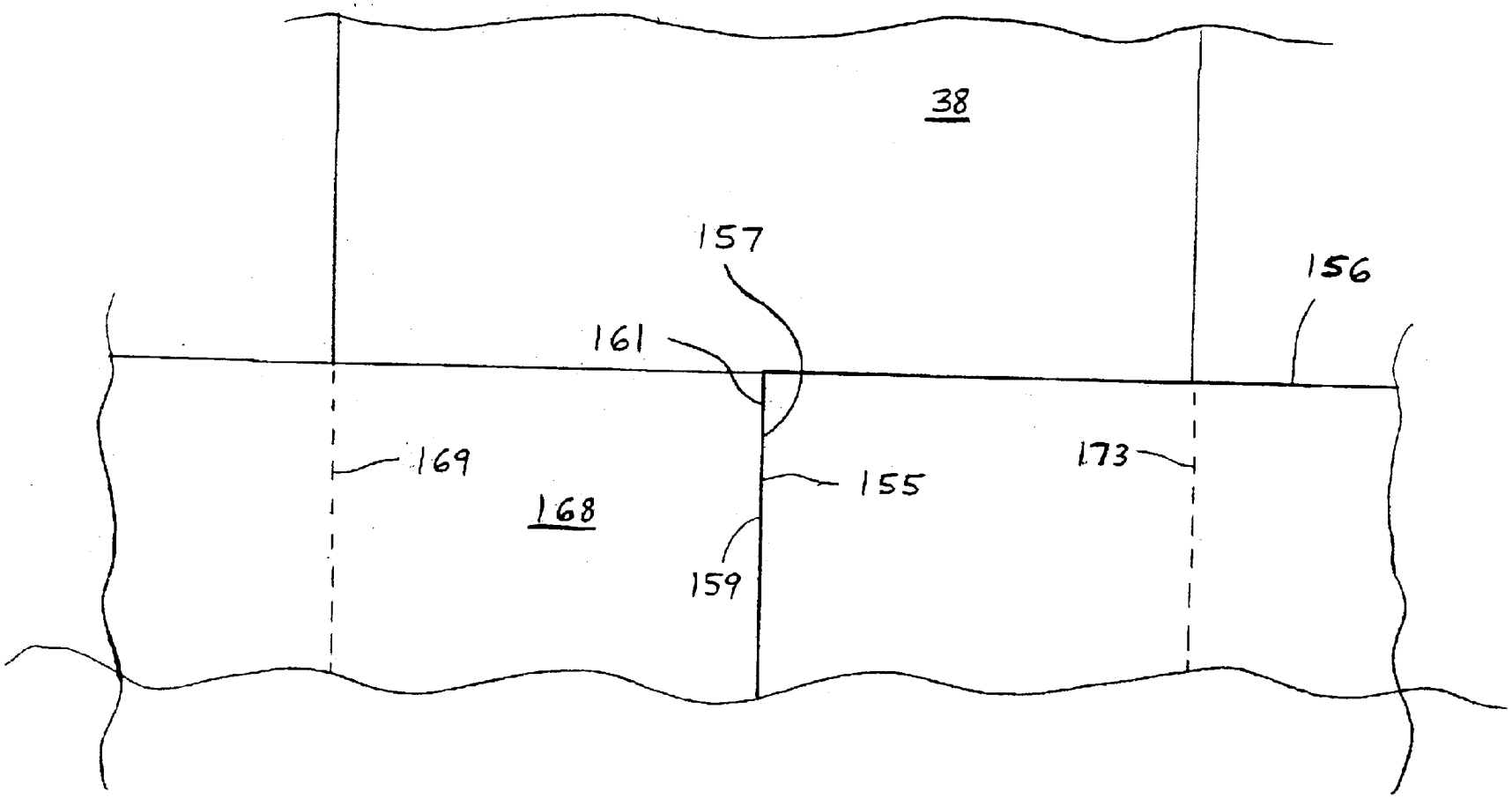
FIG. 5 is an enlarged front view of the protective apparatus of FIG. 4 along line 5—5.

In another embodiment shown in FIGS. 4–5, a protective apparatus 152 substantially encompasses or encircles the base 34 and the post body 38. A shell 154 includes a top wall 156 and four side walls 158, 160, 162 and 163. The top wall 156 has lips 169, 171, 173 and 175 which define an opening 164. Each of the lips 169, 171, 173 and 175 can engage the post body 38. Preferably, the opening 164 is sized for a snug fit against the post.

The walls 156–163 define a cavity 176 that is sized to contain the bolts and gussets, and most preferably to provide clearance above these sharp edges, as described above. The cavity can thus be configured like the cavity 86 of the previous embodiment, as modified to fully enclose the base 34.

The shell 154 includes an access opening 155, in the form of a slit extending through the entire height of the shell 154 from the opening 164 to an outer edge 168 of the shell 154. The shell 154 includes two opposing faces 157, 159, best seen in FIG. 5, that define the slit 155 therebetween. When the faces 157, 159 are manually pulled away from each other to thereby widen the access opening slit 155, the post body 38 can pass through the slit 155 into and out of the post opening 164.

The protective apparatus 152 includes a retention element that retains the shell 154 in position covering the anchoring system 20 such that the apparatus 152 cannot be easily or inadvertently removed from the anchoring system 20. More particularly, the retention element is in the form of a layer of adhesive 161 bonding the faces 157, 159. In a preferred embodiment, the adhesive can be initially applied to one face 157 or 159. A cover sheet can be initially applied to the adhesive to cover it until the apparatus 152 is ready for use. The cover sheet can be removed to expose the adhesive layer for contact with the opposite face of the access opening slit 155. Alternatively, the retention element can be in the form of mating hook and loop fasteners on each face 157, 159.

During installation, after the post body 38 has been positioned within the opening 164, the faces 157, 159 are pressed into contact with each other. The adhesive 161 adheres the faces 157, 159 together such that the shell 154 is securely retained on the post body 38 and is not likely to be inadvertently removed. However, if it is desired to remove the apparatus 152 from the anchoring system 20, the faces 157, 159 can be manually pulled apart such that the post body 38 can pass out of the post opening 164 through the slit 155.

The adhesive 161 also retains the faces 157, 159 in engagement with each other such that the shell 154 encompasses the post body 38. A comparison of FIGS. 2 and 4 reveals that the protective apparatus 152 of FIG. 4, by spanning all four sides of the body 38 with the lips 169, 171, 173 and 175, encompasses the base 34 and the post body 38, and the protective apparatus 52 of FIG. 2 does not. By virtue of the back wall 163 and the lip 175 spanning the back side of the post body 38, the protective apparatus 152 completely covers the bolts 28*a–d*, the gussets 40*a–d*, the rim 36 and the plate 24, thereby providing an added measure of protection. Moreover, the lip 175 enhances the weather-sealing capabilities of the shell. Other features of the protective apparatus 152 are substantially similar to the protective apparatus 52, and thus are not discussed in detail herein.

Figure 6:
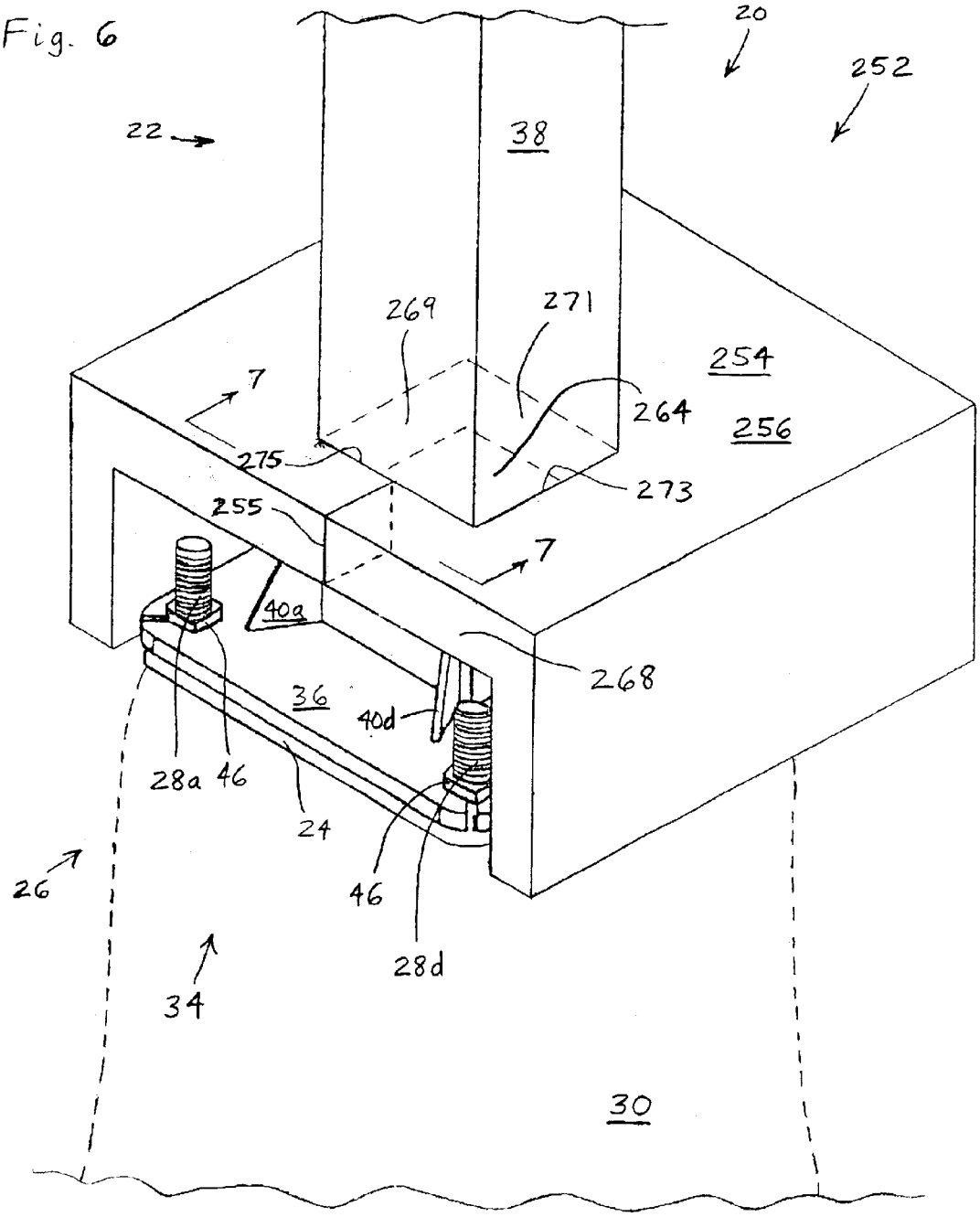
FIG. 6 is a perspective view of yet another embodiment of a basketball goal post protective apparatus of the present invention in its operative position over the base of the anchoring system of FIG. 1.
Figure 7:
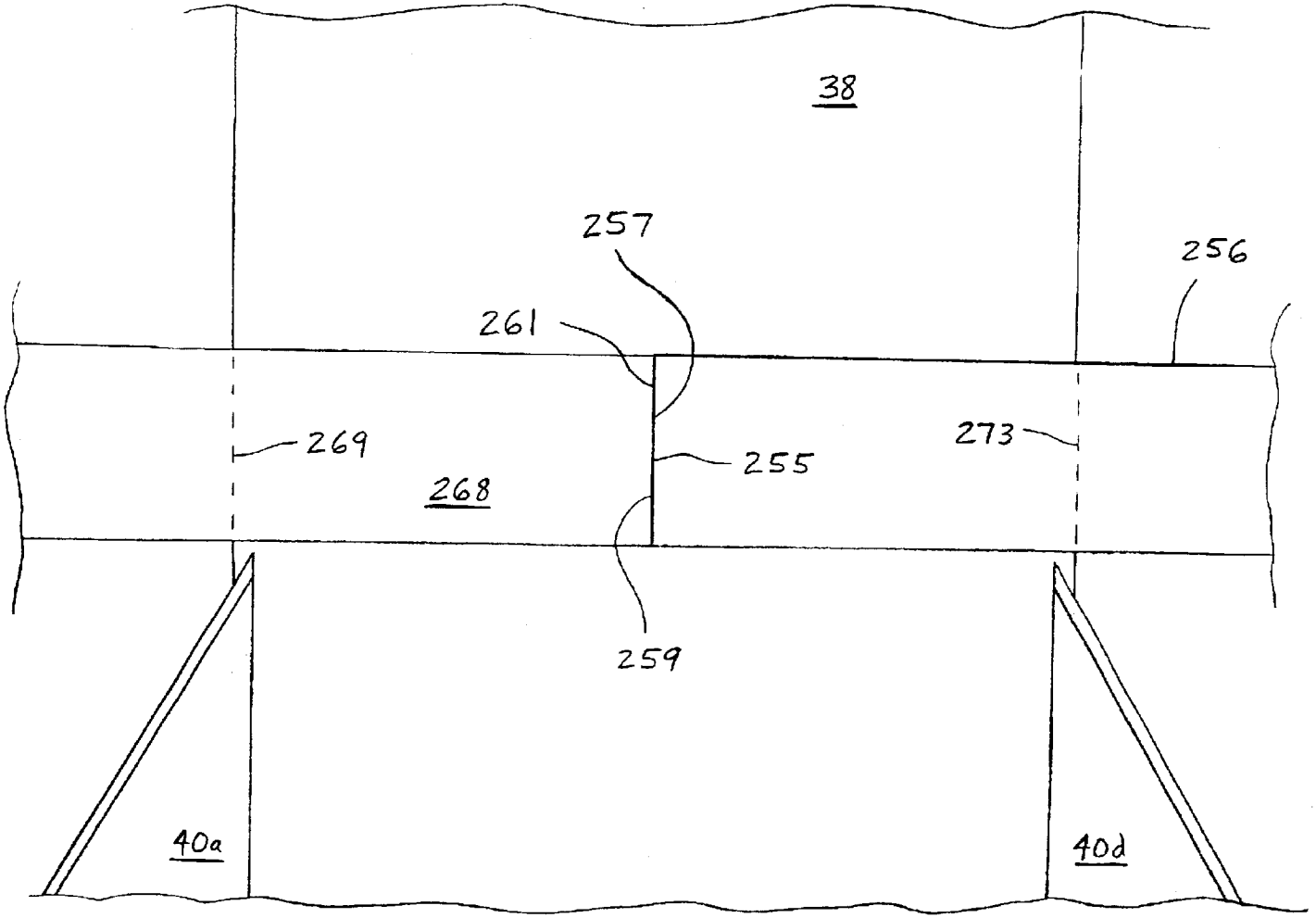
FIG. 7 is an enlarged front view of the protective apparatus of FIG. 6 along line 7—7.

In yet another embodiment shown in FIGS. 6–7, a protective apparatus 252 substantially encompasses or encircles the post body 38. A shell 254 includes a top wall 256 having lips 269, 271, 273 and 275, all of which define an opening 264. Each of the lips 269, 271, 273 and 275 can engage the post body 38. Preferably, the opening 264 is sized for a snug fit against the post.

The shell 254 includes an access opening 255, in the form of a slit extending through the top wall 256 of the shell 254 from the opening 264 to an outer edge 268 of the shell 254. The top wall 256 includes two opposing faces 257, 259, best seen in FIG. 5, that define the access opening slit 255 therebetween. When the faces 257, 259 are manually pulled away from each other to thereby widen the slit 255, the post body 38 can pass through the access opening slit 255 into and out of the post opening 264.

The protective apparatus 252 includes a retention element that retains the shell 254 in position covering the anchoring system 20 such that the apparatus 252 cannot be easily or inadvertently removed from the anchoring system 20. More particularly, the retention element is in the form of a layer of adhesive 261 bonding the faces 257, 259. In a preferred embodiment, the adhesive can be initially applied to one face 257 or 259. A cover sheet can be initially applied to the adhesive to cover it until the apparatus 252 is ready for use. The cover sheet can be removed to expose the adhesive layer for contact with the opposite face of the slit 255. Alternatively, the retention element can be in the form of mating hook and loop fasteners on each face 257, 259.

During installation, after the post body 38 has been positioned within the opening 264, the faces 257, 259 are pressed into contact with each other. The adhesive 261 adheres the faces 257, 259 together such that the shell 254 is securely retained on the post body 38 and is not likely to be inadvertently removed. However, if it is desired to remove the apparatus 252 from the anchoring system 20, the faces 257, 259 can be manually pulled apart such that the post body 38 can pass out of the post opening 264 through the access opening slit 255.

The adhesive 261 also retains the faces 257, 259 in engagement with each other such that the shell 254 encompasses the post body 38. A comparison of FIGS. 2 and 4 reveals that the protective apparatus 252 of FIG. 4, by spanning all four sides of the body 38 with the lips 269, 271, 273 and 275, encompasses the post body 38, and the protective apparatus 52 of FIG. 2 does not. By virtue of the lip 275 spanning the back side of the post body 38, the protective apparatus 252 more completely covers the bolts 28*a–d* and the gussets 40*a–d*, thereby providing an added measure of protection. Moreover, the lip 275 enhances the weather-sealing capabilities of the shell. Other features of the protective apparatus 252 are substantially similar to the protective apparatus 52, and thus are not discussed in detail herein.

Figure 8:
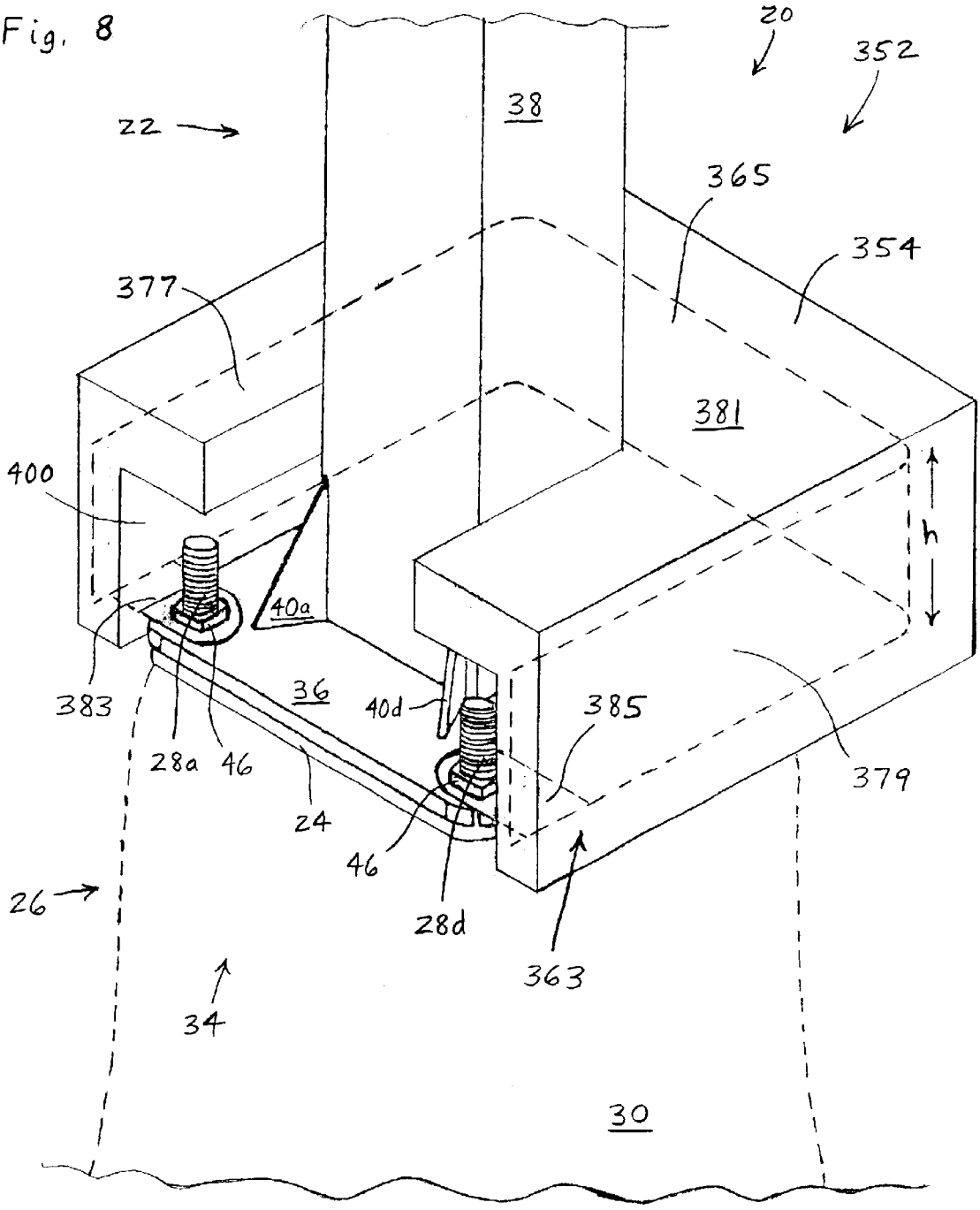
FIG. 8 is a perspective view of a further embodiment of a basketball goal post protective apparatus of the present invention in its operative position over the base of the anchoring system of FIG. 1.
Figure 9:
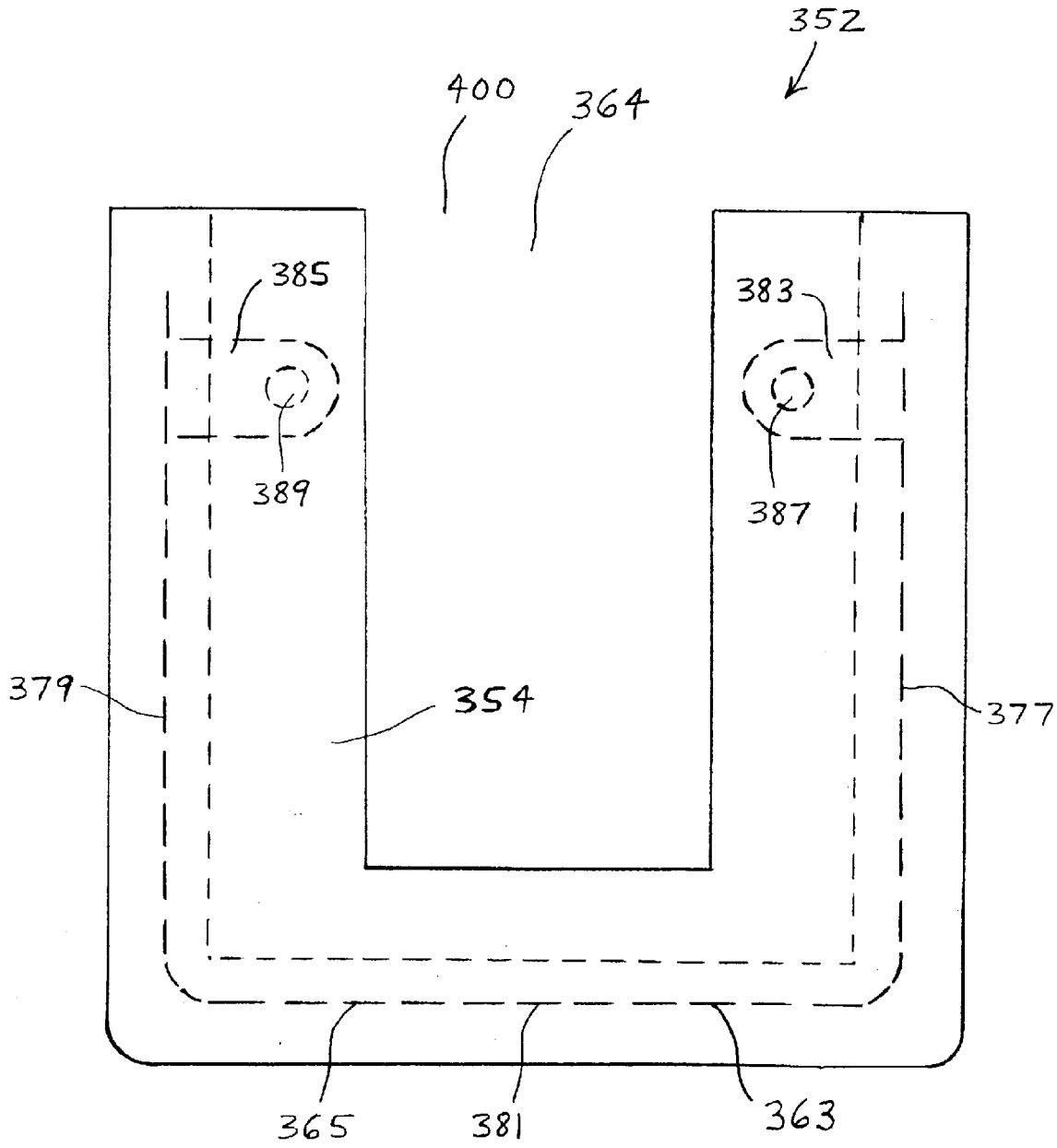
FIG. 9 is a plan view of the protective apparatus of FIG. 8.

In a further embodiment shown in FIGS. 8–9, a protective apparatus 352 includes another embodiment of a retention element for retaining a shell 354 on the anchoring system 20 such that the apparatus 352 cannot be easily or inadvertently removed from the anchoring system 20. More particularly, the retention element is in the form of a bracket or frame 363 that is attached between the shell 354 and the anchoring system 20, thereby attaching the shell 354 to the anchoring system 20. The frame 363 can be embedded in the foam material of the shell 354 or inserted into slots in the underside of the foam material which retain the frame 363 therein. Alternatively, the frame 363 can be attached to the shell 354 by use of an adhesive or other comparable permanent or removable fastener.

The frame 363 includes a U-shaped strip 365 having legs 377, 379 extending from opposite ends of a middle portion 381. As best seen in FIG. 9, the corners of the strip 365 are rounded. That is, the bends in the strip 365 where the middle portion 381 is joined to the legs 377, 379 are not at a sharp 90° angle, but rather have radii. Thus, a basketball player who makes contact with the strip 365 is not likely to be injured by its corners.

Extending in inward directions from near the distal ends of legs 377, 379 are respective horizontally oriented flanges 383, 385. Each of the flanges 383, 385 has a respective thru-hole 387, 389, as best seen in FIG. 9, sized to receive the bolts 28*a*, 28*d*, respectively.

In a preferred embodiment, the frame 363 is formed of a metal such as steel or aluminum. However, it is also possible to form the frame 363 of another material such as plastic or rubber. In a preferred embodiment, the U-shaped strip 365 has a height h of 2.5 inches, and a thickness of 0.125 inches.

During installation, the rim 36 is secured to the anchor 26 by nuts which receive the bolts 28*a–d*. After installation of the protective apparatus 352, the nuts that receive the bolts 28*a* and 28*d* are disposed under the respective flanges 383 and 385, and thus cannot be seen in FIG. 8. After the nuts have been tightened down to secure the rim 36 to the anchor 26, the post body 38 is positioned within the post opening 364 such that the apparatus 352 is disposed above the base 34. The apparatus 352 is then lowered such that the bolts 28*a*, 28*d* are received in the thru-holes 387, 389, respectively. The nuts 46, which are visible in FIG. 8, are then placed over the bolts 28*a*, 28*d* and tightened such that the flanges 383, 385 are securely attached to their respective bolts 28*a*, 28*d*. The nuts 46 can be installed and removed by hand and/or wrench through an access window 400.

The frame 363 attaches the shell 354 to the bolts 28*a* and 28*d* such that the shell 354 is securely retained on the post body 38 and is not likely to be inadvertently or inappropriately removed. However, if it is desired to remove the apparatus 352 from the anchoring system 20, the nuts 46 that are over the flanges 383, 385 can be removed from the bolts 28*a*, 28*d* to allow the flanges 383, 385 to be lifted above the bolts 28*a*, 28*d*.

Of course the frame can be designed to be attached to any one of the four bolts 28*a–d*, any subset of the four bolts 28*a–d*, or all of the four bolts 28*a–d*. The frame 363 can be provided with appropriately positioned flanges, in a number and location necessary to mate with the bolt(s). Other features of the protective apparatus 352 are substantially similar to the protective apparatus 52, and thus are not discussed in detail herein.

Figure 10:
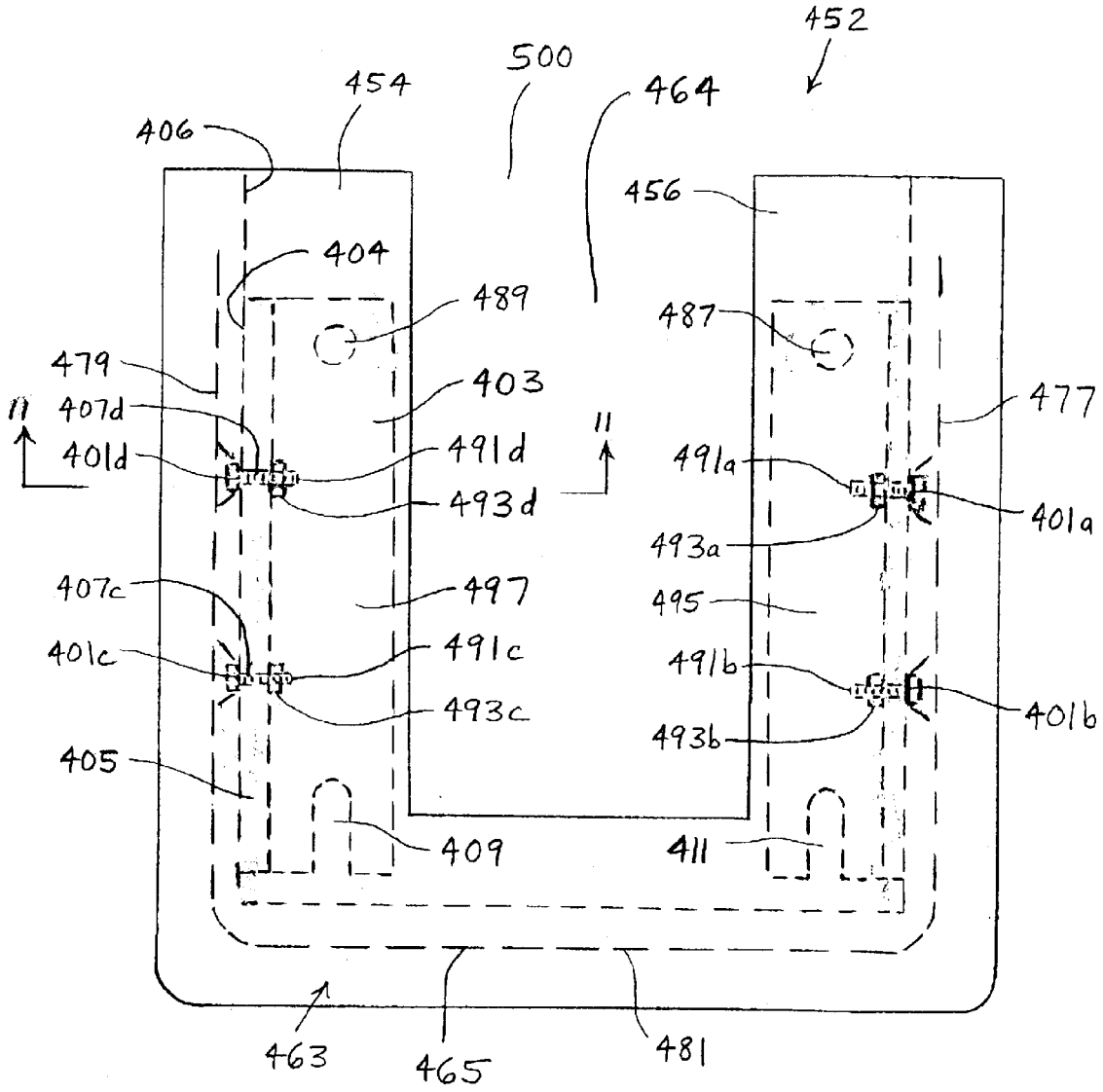
FIG. 10 is a plan view of a still further embodiment of a basketball goal post protective apparatus of the present invention.
Figure 11:
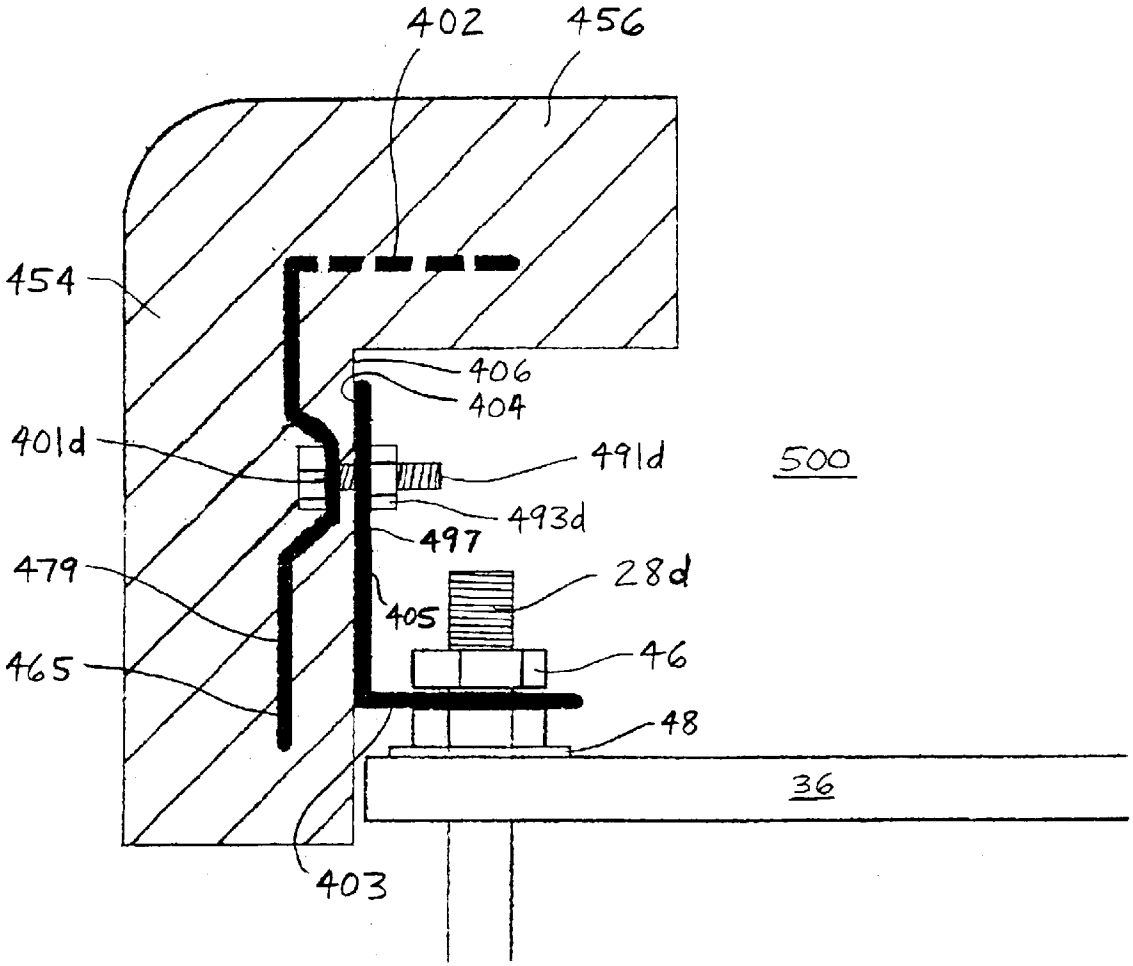
FIG. 11 is a cross-sectional view of the protective apparatus of FIG. 10 along line 11—11 with the protective apparatus attached to a basketball goal mounting base.

In a still further embodiment shown in FIGS. 10–11, a protective apparatus 452 includes yet another embodiment of a retention element for retaining a shell 454 on the anchoring system 20 such that the apparatus 452 cannot be easily or inadvertently removed from the anchoring system 20. More particularly, the retention element is in the form of a three-piece bracket 463 that is attached to both the shell 454 and the anchoring system 20, thereby attaching the shell 454 to the anchoring system 20.

The bracket 463 includes a generally U-shaped member 465 attached by bolts 491*a–d* and nuts 493*a–d* to two L-shaped members 495, 497. The U-shaped member 465 has legs 477, 479 extending from opposite ends of a middle portion 481. As seen in FIG. 10, the corners of the U-shaped member 465 are rounded. That is, the bends in the U-shaped member 465 where the middle portion 481 is joined to the legs 477, 479 are not at a sharp 90° angle, but rather have radii. Thus, a basketball player who makes contact with the U-shaped member 465 through the shell 454 is not likely to be injured by the corners of the U-shaped member 465. The U-shaped member 465 includes four countersunk thru-holes 401*a–d* for receiving the respective bolts 491*a–d* therethrough. The U-shaped member 465 can be embedded in the foam material of the shell 454 or inserted into slots in the foam material which retain the U-shaped member 465 therein. In addition, the heads of the bolts 491*a–d* are also embedded within the shell with the bolts extending through the corresponding thru-holes 401*a–d*. The head of the bolts can be welded to the U-shaped member at each thru-hole, or the U-shaped member can be configured at the thru-holes to bind the bolt head against rotation.

The U-shaped member 465 can optionally include a horizontally-oriented cantilever plate 402, seen in FIG. 11, for supporting the top wall 456. The cantilever plate 402 can be continuous along the entire lengths of the legs 477, 479 and the middle portion 481 of the U-shaped member 465.

The L-shaped member 497 includes a horizontally-oriented plate 403 attached to a vertically-oriented plate 405. The vertically-oriented plate 405 includes thru-holes 407*c–d* aligned with the thru-holes 401*c–d*, respectively, for receiving the bolts 491*c–d*, respectively. An outside surface 404 of the plate 405 engages an inside surface 406 of the shell 454. The horizontally-oriented plate 403 includes a thru-hole 489 and an open-ended slot 409 sized to receive the bolts 28*d* and 28*c*, respectively.

The L-shaped member 495 includes a thru-hole 487 and an open-ended slot 411, and is a mirror-image of the L-shaped member 497. Thus, the features of the L-shaped member 495 will not be discussed in further detail herein.

During installation, after the nuts have been tightened down to secure the rim 36 to the anchor 26, the post body 38 is positioned within the post opening 464 such that the apparatus 452 is disposed above the base 34. The apparatus 452 is then lowered such that the bolts 28*a–d* are received in the thru-hole 487, the slots 411, 409 and the thru-hole 489, respectively. By the bolts 28*b–c* being received in the slots 411, 409, respectively, the bolts 28*b–c* can provide support to the frame 463 and inhibit bending of the U-shaped member 465 that might otherwise result from an impact to the front end of the U-shaped member 465. The nuts 46 are then placed over the bolts 28*a*, 28*d* and tightened such that the L-shaped members 495, 497 are securely attached to their respective bolts 28*a*, 28*d*. The nuts 46 can be installed and removed by hand and/or wrench through an access window 500.

The bracket 463 attaches the shell 454 to the bolts 28*a* and 28*d* such that the shell 454 is securely retained on the post body 38 and is not likely to be inadvertently or inappropriately removed. However, if it is desired to remove the apparatus 452 from the anchoring system 20, the nuts 46 that are over the L-shaped members 495, 497 can be removed from the bolts 28*a*, 28*d* to allow the L-shaped members 495, 497 to be lifted above the bolts 28*a*, 28*d*.

Of course the bracket can be designed to be attached to any one of the four bolts 28*a–d*, any subset of the four bolts 28*a–d*, or all of the four bolts 28*a–d*. Other features of the protective apparatus 452 are substantially similar to the protective apparatus 52, and thus are not discussed in detail herein.

The shells of the embodiments disclosed herein are shown to be rectangular or box-shaped. However, it is also possible for the shell to have a curved outer surface. For instance, the shell can have a substantially half-spherical shape or igloo shape, with no corners, and with no edges except for the edge that faces the ground surface and the edges that define the opening that receives the post body. The shell can also have a cylindrical, conical or frusto-conical shape, with appropriate modifications to the top wall and the at least one side wall forming the shell. In these alternative embodiments, the shell still defines a cavity to enclose the sharp edges of the bolts and gussets of the base 34, and preferably still provides clearance above these components of the base.

As a further alternative, the shells of the various embodiments can be form fitting about the base 34 and its elements. With this modification, no cavity clearance is provided, but instead the shell material is molded to conform to the outer geometry of the base, bolts and gussets. However, with this approach, the shell must be molded to the particular base design, which reduces the preferred universality of the protective apparatus.

The protective apparatus of the present invention can be produced by known molding techniques suitable for the particular material. For instance, for a preferred shell material of polyurethane foam, an injection or a blow molding process can be implemented. The blow molded shell can be of medium density to create the optimum resilience, deformability, resistance to deformation and longevity.

While this invention has been described as having a preferred design, the present invention can be further modified within the spirit and scope of this disclosure. This application is therefore intended to cover any variations, uses, or adaptations of the invention using its general principles. This application is intended to cover such departures from the present disclosure as come within known or customary practice in the art to which this invention pertains and which fall within the limits of the appended claims.

What is claimed is:

1. A protective apparatus for covering protruding features on a mounting base of an in-ground anchoring system for a basketball goal post, said apparatus comprising:

a shell formed of a resiliently deformable material, said shell defining a post opening configured to receive the basketball goal post therethrough and an access opening in communication with said post opening and configured for passage of the goal post therethrough to enter said post opening, said shell defining a cavity beneath said post opening, said cavity sized to enclose the protruding features on the mounting base when the goal post is received in said post opening, wherein said access opening is a slit defined by two opposing faces in said shell and includes an adhesive strip attached to one of said opposing faces and having a cover sheet that is removable therefrom to expose an adhesive for engaging the other of said opposing faces.

2. The protective apparatus of claim 1, wherein said shell includes a top wall and a plurality of side walls integrally formed with said top wall, said top wall and side walls combining to define said cavity.

3. The protective apparatus of claim 2, wherein said shell is deformable at said slit to permit widening of said slit for passage of the goal post therethrough.

4. The protective apparatus of claim 2, wherein said top wall is generally rectangular with four edges, and said plurality of side walls includes only three side walls integral with a corresponding one of said three edges.

5. The protective apparatus of claim 1, wherein said shell includes a top wall with a perimeter and at least one side wall integral with said top wall and contiguous around the perimeter of said top wall.

6. The protective apparatus of claim 5, wherein said access opening is a slit defined in said top wall and one of said at least one side wall, whereby said shell is deformable at said slit to permit widening of said slit for passage of the goal post therethrough.

7. A protective apparatus for covering protruding features on a mounting base of an in-ground anchoring system for a basketball goal post, said apparatus comprising:

a shell defining a post opening configured to receive the goal post therethrough and a cavity beneath said opening configured to enclose the protruding features when the goal post is received in said post opening; and a retention element attached to said shell and operable to retain said shell on the mounting base, wherein said shell defines an access opening in communication with said post opening and configured for passage of the goal post therethrough to enter said post opening; and said retention element includes an adhesive device configured to adhere two surfaces of said shell to close said access opening when said shell is disposed over the mounting base with the goal post extending through said post opening.

8. A protective apparatus for covering protruding features on a mounting base of an in-ground anchoring system for a basketball goal post, said apparatus comprising:

a shell defining a post opening configured to receive the goal post therethrough and a cavity beneath said opening configured to enclose the protruding features when the goal post is received in said post opening; and a retention element attached to said shell and operable to retain said shell on the mounting base, wherein said retention element includes a portion extending into said cavity and configured to be attached to the mounting base.

9. The protective apparatus of claim 8, in which the protruding features on the mounting base includes a bolt, wherein said portion of said retention element defines a bolt opening configured to receive the bolt therethrough when said shell is disposed over the mounting base.

10. The protective apparatus of claim 9, wherein said retention element includes a strip portion embedded within said shell and said portion of said retention element includes a flange projecting from said shell, said flange defining said bolt opening.

11. The protective apparatus of claim 9, wherein said portion of said retention element includes at least two flanges projecting from said shell into said cavity, each of said at least two flanges defining a bolt opening for receiving a corresponding bolt of the mounting base therethrough.

12. The protective apparatus of claim 8, wherein said retention element includes an elongated plate defining bolt openings at its opposite ends configured to receive a corresponding bolt of the mounting base therethrough.

13. The protective apparatus of claim 12, wherein one of said bolt openings is a slot.

14. The protective apparatus of claim 12, wherein said retention element includes a plate embedded within said shell and a fastener connecting said embedded plate with said elongated plate.

* * * * *